US005697385A

United States Patent [19]

Seymour et al.

[11] Patent Number: 5,697,385

[45] Date of Patent: Dec. 16, 1997

[54] ON-LINE BASIS MEASUREMENT SYSTEM FOR CONTROL OF TOBACCO CAST SHEET

[75] Inventors: Sydney Keith Seymour; Calvin Wayne Henderson, both of Clemmons; Jack Gray Flinchum, King; Ford Mitchell Shore, Clemmons, all of N.C.

[73] Assignee: R. J. Reynolds Tobacco Company, Winston-Salem, N.C.

[21] Appl. No.: 659,477

[22] Filed: Jun. 6, 1996

[51] Int. Cl.[6] ..... A24B 3/14; A24B 15/24

[52] U.S. Cl. ..... 131/370; 131/354; 131/371; 131/374

[58] Field of Search ..... 131/354, 370, 131/371, 374; 118/664, 665; 162/198, 123, 135, 263, 265

[56] References Cited

U.S. PATENT DOCUMENTS

| | | | |
|---|---|---|---|
| 2,734,510 | 2/1956 | Hungerford et al. | 131/354 |
| 2,909,660 | 10/1959 | Alexander . | |
| 2,937,280 | 5/1960 | Gilman . | |
| 3,038,401 | 6/1962 | Bossen . | |
| 3,073,153 | 1/1963 | Petitjean . | |
| 3,207,901 | 9/1965 | Barker, Jr. . | |
| 3,619,360 | 11/1971 | Persik, Jr. . | |
| 3,634,187 | 1/1972 | Chari et al. . | |
| 3,687,802 | 8/1972 | Rummel et al. . | |
| 4,006,358 | 2/1977 | Howarth . | |
| 4,069,086 | 1/1978 | Reif | 118/664 X |
| 4,421,126 | 12/1983 | Gellatly | 131/371 |
| 4,648,712 | 3/1987 | Brenholdt . | |
| 4,840,706 | 6/1989 | Campbell . | |
| 4,941,482 | 7/1990 | Heitmann et al. . | |
| 4,942,363 | 7/1990 | Lowitz . | |
| 4,957,770 | 9/1990 | Howarth . | |
| 5,071,514 | 12/1991 | Francis . | |
| 5,393,378 | 2/1995 | Yakabe et al. . | |
| 5,499,636 | 3/1996 | Baggett, Jr. et al. | 131/374 |

*Primary Examiner*—Vincent Millin
*Assistant Examiner*—Eric P. Raciti

[57] ABSTRACT

A real-time cast sheet weight monitoring and control system in which the weight of a cast base sheet of wet laid tobacco slurry as well as the weight of a composite tobacco cast sheet formed by applying dry granular tobacco to the wet laid cast sheet prior to drying is disclosed in which two beta gauge sheet weight sensing devices are used to provide input signals to a controller which alternately uses those signals to monitor and control the weight of the cast base sheet by means of controlling the servo drive motors of a casting blade in a head box which is casting the wet laid sheet onto a stainless steel belt and which also uses those same signals to control the variable speed drive of a top loader for controlling the amount of dry granular tobacco which is uniformally applied to the wet laid cast base sheet prior to the drying of the composite tobacco cast sheet material formed thereby. The controller primarily monitors and controls the total weight of the composite tobacco cast sheet but interrupts that monitoring and control function periodically to monitor and control the weight of the wet laid cast base sheet.

32 Claims, 3 Drawing Sheets

ON-LINE BASIS MEASUREMENT SYSTEM FOR CONTROL OF TOBACCO CAST SHEET

BACKGROUND OF THE INVENTION

The present invention is directed to an on-line basis weight measurement and control system for a cast sheet of tobacco. More particularly, the present invention is directed to a measurement system for determining the basis weight of a cast sheet web to which is tobacco added. The present invention measures and controls not only the weight of the cast web, but the total weight of the cast web plus the top load of tobacco.

In the production of cigarettes, it is desirable to produce a composite tobacco cast sheet material which is later utilized to make cigarette rods. Such a composite tobacco cast sheet material is produced by casting a wet laid tobacco slurry onto a stainless steel belt and then uniformally applying a dry granular tobacco top load to the wet laid sheet prior to drying the composite cast sheet. The composite cast sheet is then dried and reconditioned if necessary, doctored from the stainless steel belt and then redried, in a conventional manner. After drying, the composite tobacco cast sheet is ready to be used to be manufactured into finished cigarette rods.

During the course of producing the composite tobacco cast sheet, many problems have arisen. The major problem is the control of the weight of the cast sheet itself, as well as the profile of the cast sheet. An additional problem is the control of the sheet top load percentage, or the amount of the top load of tobacco that is applied to the wet tobacco slurry during the manufacturing of the composite tobacco cast sheet. It is obviously important and desirable to produce a finished composite tobacco cast sheet material having minimal variability with respect to the sheet profile, sheet weight and sheet top load percentage of tobacco in order to produce a product which meets the desired performance standards.

In addition to the minimization of the variability of the composite tobacco cast sheet material being produced, it is desirable to control, in real-time, the quality of the finished product. Also, it is always desirable to increase production throughput of the composite tobacco cast sheet material being produced.

There have been various types of prior art systems proposed for measuring the density or moisture content of a tobacco stream. For one reason or another, however, those prior art systems have had various shortcomings. The present invention overcomes those shortcomings to provide an accurate real-time system for measuring the basis weight of a cast base sheet, monitoring and then providing a feedback signal for improving the final composite tobacco cast sheet material product, all in a novel manner.

The prior art, for example, U.S. Pat. No. 2,937,280 to Gilman, discloses the use of a combination of a radiation type measuring device and a dielectric detector for measuring the percentage of moisture of a moving stream of tobacco on a continuous basis. Various measurements are taken by the beta detector and the electrodes of the dielectric detector. The weight of the tobacco measured by the beta gauge and the total moisture determined by the dielectric detector cannot be combined simultaneously, but must be combined at a definite time after the measurements are made. No provision is made for real-time measurement during manufacture nor for adjusting the profile of the cast sheet. Nor is the Gilman patent at all concerned with monitoring or controlling the sheet top load percentage.

A patent which discloses apparatus for measuring the density of a tobacco stream is U.S. Pat. No. 4,941,482, to Heitmann et al. That patent is directed to an apparatus which can measure the density of successive increments of an advancing tobacco stream with a much higher accuracy than achievable therebefore. One or more infrared light sources are utilized to measure the density of the steam of tobacco which is just below a foraminous conveyor which attracts the tobacco stream to its underside by suction. An infrared radiation type of monitoring device is used to control a trimming station such that surplus tobacco is removed from the continuous filler which is formed by a means of the foraminous conveyor prior to the finished filler entering the wrapping mechanism.

In addition, two infrared detectors and receivers, located in different places along the path of the tobacco stream are used to control a variable-speed motor for an impeller which serves to propel the particles of tobacco through a duct at a rate which is a function of the rotational speed of the impeller. The tobacco particles are lifted from the duct at the foraminous conveyer to form the tobacco stream.

The Heitmann et al. reference, in addition to not being concerned with a wet laid tobacco slurry nor a top load of tobacco being placed on that slurry to form a composite tobacco cast sheet product, utilizes two sets of infrared detection systems spaced across the length of the tobacco stream. That reference is not concerned with obtaining and controlling the thickness profile of the cast tobacco sheet product nor of controlling the weight of the sheet top load tobacco. In short, a more accurate and improved system for controlling the profile and weight and sheet top load percentage for a composite tobacco cast sheet material is still necessary and desirable, especially in light of the prior art.

SUMMARY AND OBJECTS OF THE INVENTION

In light of the shortcomings of the prior art in dealing with streams of tobacco, it is clear that there still exists the need in the art for a system which can be used to accurately monitor and control the sheet weight and percentage top load of a composite tobacco cast sheet material product. It is, therefore, a primary object of the present invention to provide a system for monitoring and controlling the weight and sheet profile of a composite tobacco cast sheet product.

It is also a primary object of the present invention to provide a system for monitoring and controlling the percentage top load of a composite tobacco cast sheet product, in a simple, accurate and reliable manner.

It is a further object of the present invention to provide a real-time system for measuring and controlling the basis weight of a cast sheet web, based upon predetermined parameters.

It is yet a further object of the present invention to provide a composite tobacco cast sheet material control system which, in addition to providing an automatic feedback control based upon the measured parameters of the weight and top load percentage, provides trend and log data for quality assurance.

It is still a further object of the present invention to provide a system for monitoring and controlling a composite tobacco cast sheet product to achieve an improvement in the capacity and throughput of the produced product in response to continuous operation of the system which produces the composite tobacco cast sheet product at optimum sheet conditions.

These and other objects of the present invention are accomplished by providing a pair of particle radiation sensors which monitor the composite tobacco cast sheet product and provide feedback signals for controlling both the operation of the head box which lays down the wet slurry onto a conveyer, as well as the top loader which serves to drop the dry granular tobacco onto the wet laid sheet prior to the drying of the sheet. The beta particle sensing devices are operated during a short period of time to provide real-time feedback control for the thickness or profile of the cast base sheet. Most of the time the beta particle sensing devices are used to provide feedback signals for the top load of the granular tobacco. In that manner, a single pair of beta particle radiation sources and digital detectors are utilized to monitor and control both the profile and basis weight of the cast sheet as well as the application of the dry granular top load tobacco to that cast sheet.

The reference signals generated for controlling the base sheet weight are used to drive servo motors which control the casting height of the wet laid tobacco slurry onto a stainless steel belt. The top load tobacco is controlled by an average of the two total weight reference signals which are produced by the beta gauge sheet weight sensing devices and associated circuitry. That average signal is used to control the speed of the motor which drives the top load device. In that manner, uniformity of the composite tobacco cast sheet product is achieved, while at the same time increased throughput production of that product is also obtained, at minimal cost for sensors and associated circuitry. Because less circuitry and fewer sensors are necessary to accomplish the objectives of the invention, the system requires less maintenance and experiences less downtime than prior art systems.

DETAILED DESCRIPTION OF THE PREFERRED EMBODIMENT

Figure 1:
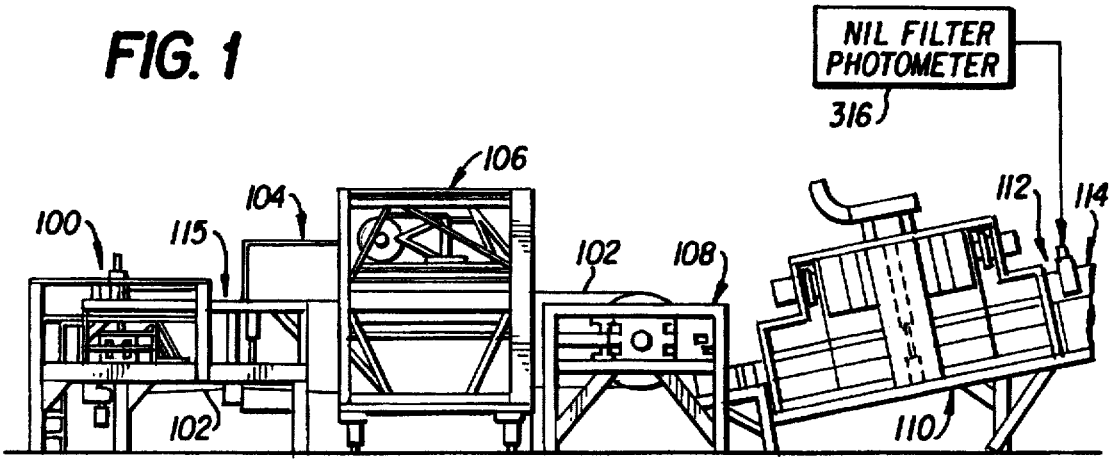
FIG. 1 is the drawing of a side perspective view of the system for producing the composite tobacco cast sheet product which is to be controlled on a real-time basis so that a uniform optimum product is produced.

Referring now to the drawings wherein like reference numerals are used to indicate like elements throughout, there is shown in FIG. 1 the machinery of a cast sheet line which is used to produce a composite tobacco cast sheet 200. It is believed that the machinery shown in FIG. 1 will be known to those of ordinary skill in the art and, therefore, only a brief description of the cast sheet line is provided.

The cast sheet line includes a head box 100 which is used to cast a wet laid tobacco slurry which forms the cast base sheet 115 onto a stainless steel belt 102 in a known manner. The stainless steel belt 102 passes beneath a top loader 104 which is motor operated by a top load variable speed drive 520. The faster the speed of the drive of the 520 of the top load device 104, the more dry granular tobacco is laid on top of the wet laid sheet 115.

Figure 2:
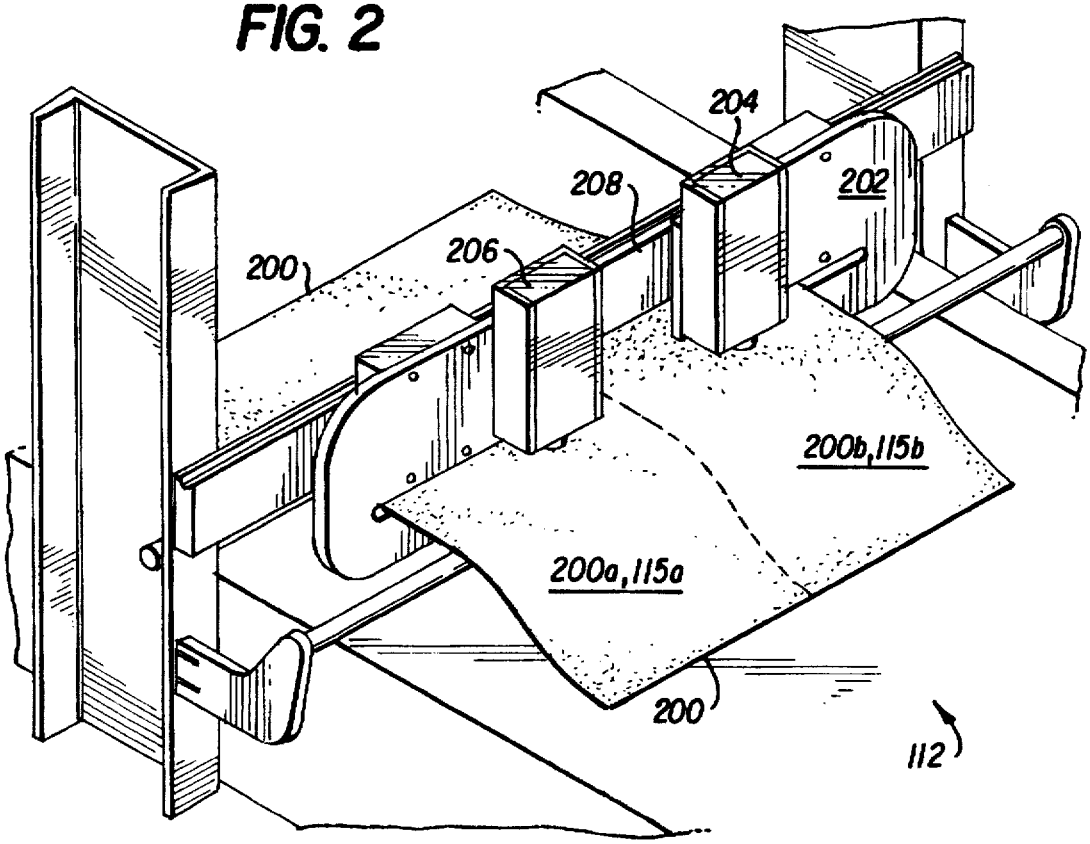
FIG. 2 is a drawing of a perspective view of the digital radiation system mounted at the end of the cast sheet line shown in FIG. 1.

After the dry tobacco is laid onto the cast base sheet 115, it forms the undried composite tobacco cast sheet 200. The composite tobacco cast sheet 200 then passes through a dryer 106, while it is still on the stainless steel belt 102. The composite tobacco cast sheet 200 is then doctored from the stainless steel belt 102 by a doctoring machine 108 and then passes through a redrying machine 110, all in a known manner. Prior to entering a dicer 114, the composite tobacco cast sheet 200 passes through a radiation sensing station 112, which is shown in greater detail in FIG. 2. The function of the radiation station 112 will be described in greater detail herein.

The radiation station 112 is preferably placed at the end of the composite tobacco cast sheet production line, and forms part of the automated control system of the present invention, which provides for an accurate and continuous production of the composite tobacco cast sheet 200.

The radiation sensing station 112 is formed from a c-frame 202, through which the composite tobacco cast sheet 200 passes prior to the entrance of the composite tobacco cast sheet 200 into the dicing machine 114. The c-frame 202 is mounted in a known manner at the output of the redryer 110. Also attached to the c-frame 202 are a right sensor 204 and a left sensor 206. Those two sensors are mounted such that they can slide along a ball slide 208 so as to enable the two sensors 204 and 206 to be placed at any point across the width of the composite tobacco cast sheet 200. The ball slide 208 also allows for the sensors 204, 206 and sources 306, 308 to be pulled off the cast sheet 200 so that they can be standardized by measuring the air gap.

Figure 3:
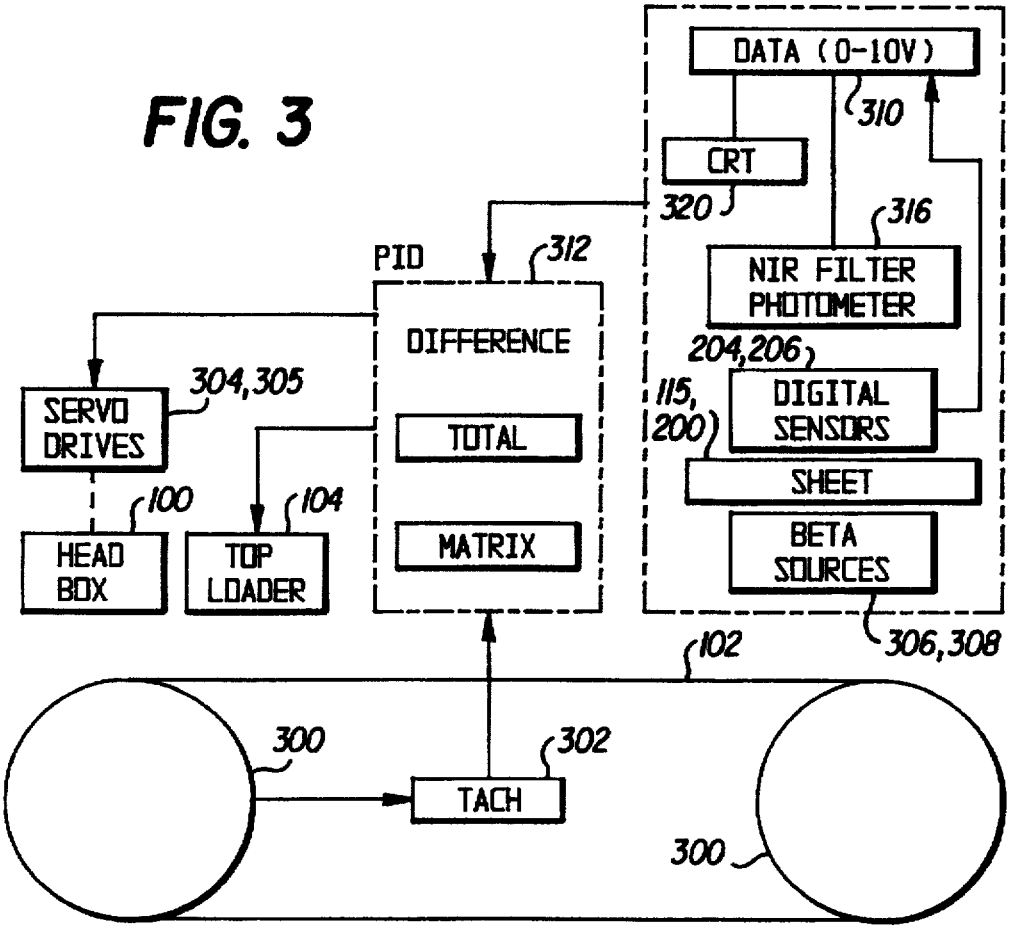
FIG. 3 is a schematic block diagram of the control system of the present invention showing the interconnection between the monitoring and control system and the components of the cast sheet line for producing the composite tobacco cast sheet material.

Preferably, the right and left sensors 204 and 206, respectively, are placed equidistant from their respective outside edge of the cast sheet 200 in such a manner that they each monitor one-half of the width of the composite tobacco cast sheet 200. As shown in FIG. 3, a like number of beta sources 306, 308, are positioned directly beneath the digital sensors 204, 206, so that beta particles released by the beta sources 306, 308 which pass through the composite tobacco cast sheet 200 are detected by the digital sensors 204, 206, in a known manner. The digital sensors 204, 206 and the beta sources 306, 308 are preferably ATI Model 100K, available from ATI of Gaithersburg, Md. The beta sources 306, 308 are attached at the output of the production line at the discharge end of the drying machine 110, in a known manner.

Referring now to FIG. 3, there is shown, in schematic block diagram form, the apparatus of the present invention which is used to control certain of the machines in the production line so as to produce a composite tobacco cast sheet product having the desirable characteristics. As shown in FIG. 3, the output from the digital sensors 204, 206, is fed to a data collection device 310, which may preferably be Pro-Log 486DX Workstation, also available from ATI. The voltage signal available as the output from the data collection device 310 is proportional to the amount of beta particle radiation which is absorbed by the composite tobacco cast sheet 200, which is itself indicative of the basis weight in grams per square meter of the composite tobacco cast sheet 200 and, as will be described, also of the cast base sheet 115. The basis weight and absorbance of the beta particles are related to each other by the formula:

$$\text{Basis Weight} = K_0 + K_1 A + K_2 A^2 + K_3 A^3 \quad (1)$$

$$\text{where, } A = -\text{Log}\left[\frac{\text{Readings}_{sample}}{\text{Readings}_{Air}}\right] \quad (2)$$

Each sensor is calibrated with a set of, for example, 7 Mylar sheets of known basis weight covering the desired basis weight range. A mathematical model fitting technique is used to compute the coefficients $K_0$, $K_1$, $K_2$ and $K_3$.

The voltage signal output from the data collection device 310, which may preferably be a voltage between 0 and 10 volts DC, is fed to a calculation and control circuit 312. That calculation and control circuit 312, the operation of which is explained in further detail in connection with FIGS. 4–6, also receives an input signal from the tachometer 302 which monitors the speed of the conveyer belt 102 by monitoring the rotational speed of one of the drive rollers 300 which serve to power the stainless steel conveyor belt 102.

The calculation and control circuitry 312, after receiving as inputs the output from the tachometer 302 as well as the outputs from the digital sensors 204, 206 through the data collection device 310, serves to control the motor 520 of the top loader 104 as well as the servo motors 304, 305 which control the height of the casting blade 404 of the head box 100. The calculating and control system 312 is therefore able to control the amount of wet laid tobacco slurry that is cast onto the stainless steel belt 102 and to thereby control the sheet profile or height or thickness and the sheet weight of the cast wet laid tobacco slurry. By controlling the motor 520 of the top loader 104, as previously described, the sheet top load percentage and therefore the total weight of the composite tobacco cast sheet product 200, can also be controlled.

The controller 312 generates a reference signal for the left side 115*a* and the right side 115*b* base sheet weights, using the outputs from the digital sensors 204, 206, after they pass through the data collection device 310. The generated reference signals are used to drive the left and right servo motors 304, 305 which control the casting height of the wet laid base sheet 115 by controlling the height of the casting blade 404 in the head box 100. The control of the servo motors 304, 305 can be performed through a variety of control modes, including PID, floating point control, or comparator adjustment.

The total sheet weight is controlled by finding the average of the two total weight reference signals, that is, by utilizing the two signals output from the digital sensors 204 and 206. The controller 312 then generates a top loader signal which is used to control the top load device 104. The controller 312 can also control the top load device 104 through a variety of control modes, including PID, floating point control, or comparator adjustment.

Figure 4:
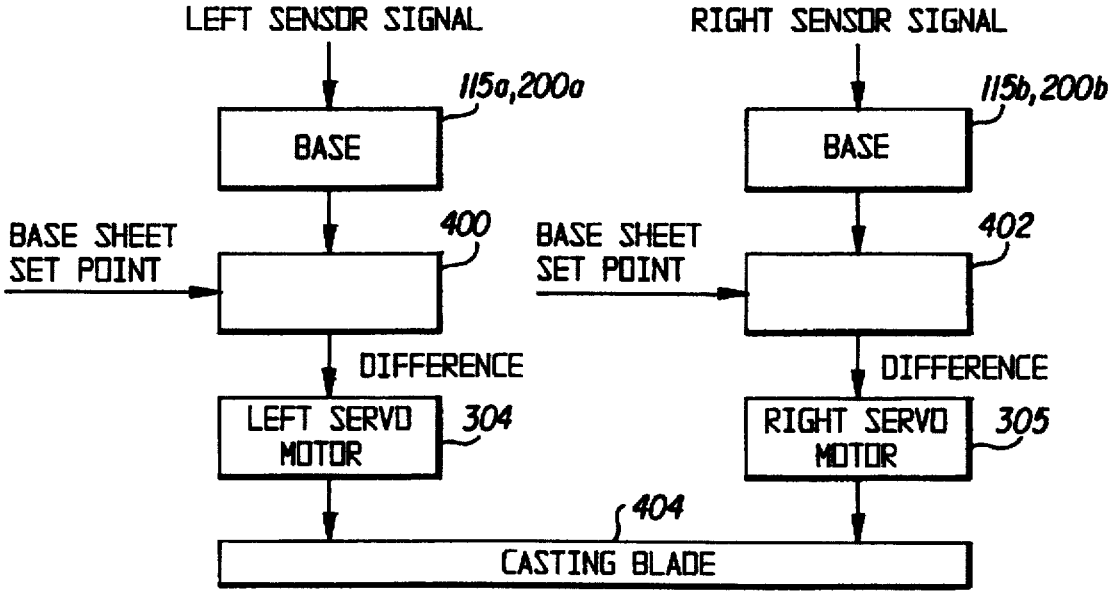
FIG. 4 is a schematic block diagram showing the sensors and other circuitry which are used to monitor the cast base sheet and to provide real-time feedback control for the cast base sheet.

Referring now to FIG. 4, there is shown in block diagram form the control process for controlling the height or thickness of the base sheet 115. As shown in FIG. 4, the left and right sensor signals generated by the digital sensors 204, 206 by means of sensing the absorbance of beta particles from the beta sources 306, 308, through the two sides of the cast base sheet 115*a*, 115*b* are used to produce base sheet control signals, which are represented by voltage signals for the left and the right sides of the cast base sheet 115*a*, 115*b*, respectively. Those voltage signals are fed to respective subtractors 400, 402, which also receive as voltage signals the base 115 sheet set point values. The cast base sheet 115 set point values represent the desired thickness or height of each side of the cast base sheet 115*a*, 115*b*.

Each of the subtractor circuits 400, 402 (the subtraction function could also be performed by software running on a personal computer) produce respective difference signals which are used to drive the left and right servo motors 304, 305 which function to move the casting blade 404 of the head box 100 up or down in a vertical direction within the head box 100 in order to control the height of each side of the cast base sheets 115*a* and 115*b*.

Figure 5:
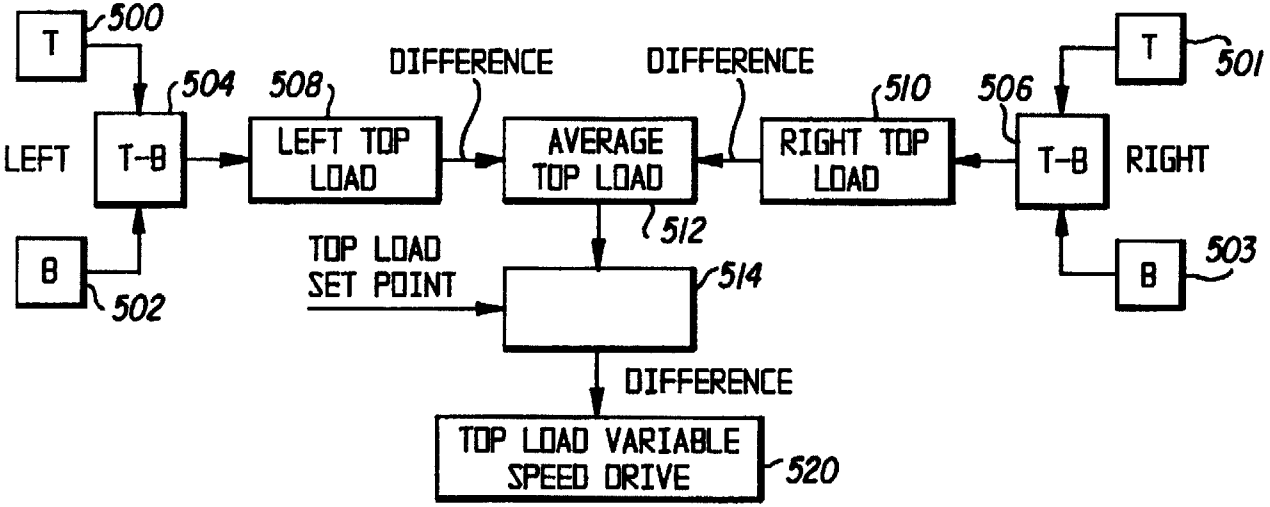
FIG. 5 is a schematic block diagram of the sensors and circuitry used for monitoring and controlling the tobacco top load on a real-time basis.

FIG. 5 shows the control process for controlling the top load tobacco which is placed on top of the cast base sheet 115 by the top loader 104 to form the composite tobacco cast sheet 200. The weight values for the total weight 500, 501 of the composite tobacco cast sheet 200 and for the weight 502, 503 of the base sheet 115 are generated in the controller 312 in the following manner. The digital sensors, 204 and 206, generate digital pulses (+5 volts TTL) and a digital counter in the data acquisition device 310 accumulates the pulses from the sensors over a 2000 millisecond period with two averages to give a measurement interval of 4 seconds. During a standardization mode, each radiation sensor 204, 206 is pulled off line to measure the counts from the air gap. That is the source of the reference data used in equation (2). Each radiation sensor is then placed back on line in the normal operating position and the readings are combined with the stored air gap readings to compute the absorbance values. These values are then used in equation (1) to calculate the basis weight.

A CRT display 320 is connected to the data acquisition device 310 and several graphic screens, selectable by the operator, display the left, right and average basis weight of the cast base sheet 502, 503 and the composite cast sheet 500, 501. The data may be displayed in one of many formats, such as trend lines, bar graphs, big numbers and tabular, and is updated every 4 seconds. Useful statistical parameters such as mean and standard deviation, may also be displayed. When control limits are exceeded the data acquisition device 310 generates graphical warnings as well as triggers electrical alarm signals. An internal software program also displays and saves Statistical Process Control information. Data can also be captured on one or more 3.5" disks to facilitate porting to other computer systems for further processing. If desired, the data acquisition device 310 can be remotely controlled by a system manager computer via a serial or other link.

The measured basis weights are sent to the controller 310 via two analog outputs representing the left and right sides. The controller 312 is also connected to the line speed tachometer 302. The controller 312 runs a special timing sequence shown in FIG. 6 and combines the line speed information with that of an internal timer to derive the actual length of sheet produced. At the start sequence 606, the top loader variable speed drive 520 is turned off so the radiation sensors 204, 206 only see the cast base sheet 115. The base sheet 115 is measured and controlled to the base sheet set point and the base sheet information is stored in a base sheet register. After a specified length of base sheet is produced, the sequence 608 begins, which turns on the top load variable speed drive 520 at a known set point. The radiation sensors 204, 206 will then measure the top loaded composite tobacco cast sheet 200. The controller 312 uses these continuous real time composite sheet basis weights 500, 501 together with the stored base sheet weights 502, 503 in a subtractor 504, 506 for each side. The computed differences 508, 510 are the respective amount of granulated tobacco being added to the cast base sheet 115.

An averager 512 combines the differences 508, 510 and computes the average amount of tobacco being added to the cast base sheet 115. A signal proportional to the average top load is sent to a comparator 514 which compares this signal to the top load set point. An error or difference signal is then sent to the top load variable speed drive 520 for proportional control. This sequence 608 continues until the controller 312 starts the sequence 610, which is similar to the sequence 606, and the process repeats itself. In order to maximize productivity, the amount of composite material measured compared to cast base sheet 115 may be changed by setting the appropriate parameters in the controller 312. In an ideal situation, the sequences 608, 612 and 616 are significantly longer than the sequences 606, 610, 614.

The NIR filter photometer 316 is located between the radiation sensing station 112 and the dicing machine 114. The filter photometer 316 generates an analog output signal (0–10 VDC) proportional to the moisture content of the cast base sheet 115 and composite tobacco cast sheet 200. That signal is applied to the analog input of the data collection device 310 and is sampled every 2000 milliseconds. The data collection device 310 displays the moisture value on the CRT display 320. The data collection device 310 also combines the moisture data with the basis weight data to compute the dry weight of the cast sheets, both base 115 and composite tobacco 200.

As previously described, the digital sensors 204 and 206 are used to divide the width of the composite tobacco cast sheet 200 into a left portion 200*a* and a right portion 200*b*. The top load control process then generates a total sheet weight signal 500, 501 and uses the base sheet weight signals for each of the left and right sides 115*a*, 200*a*, 115*b*, 200*a*, 200*b* of the cast base sheet 115 and the composite tobacco cast sheet 200. The total sheet weight and base sheet weight signals generated preferably represent each half of the cast base sheet 115 and of the composite tobacco cast sheet 200. Those signals 500–503 are then used to calculate the weight of the top load by subtracting the base sheet weight signals 502, 503 from the total sheet weight signals 500, 501 for each half or side of the cast base sheet 115*a*, 115*b* and composite tobacco cast sheet 200*a*, 200*b* at, for example, two subtractors 504 and 506, or using software operating on a personal computer.

The two signals representing the difference between the total and base sheet weights for each half or side of the composite tobacco cast sheet 200, which represent the weight of the left top load 508 and the weight of the right top load 510, are then fed to an averaging device 512 to obtain an average top load signal. The averaging device 512 may be an averaging circuit or can be implemented in software on a personal or other computer. The average top load signal produced by the averaging device 512 is used at element 514, together with a top load set point signal, to determine the difference between the desired top load of tobacco on the composite tobacco cast sheet 200 and the actual average top load of tobacco on the composite tobacco cast sheet 200. The element 514 may be a subtractor circuit or is preferably represented in software running on a personal computer.

Once a difference signal is produced at the output of the subtractor 514 which corresponds to the desired adjustment in the amount of the top load tobacco being placed on the cast base sheet 115, that difference signal is used to control the top load variable speed drive 520 of the top loader 104.

Figure 6:
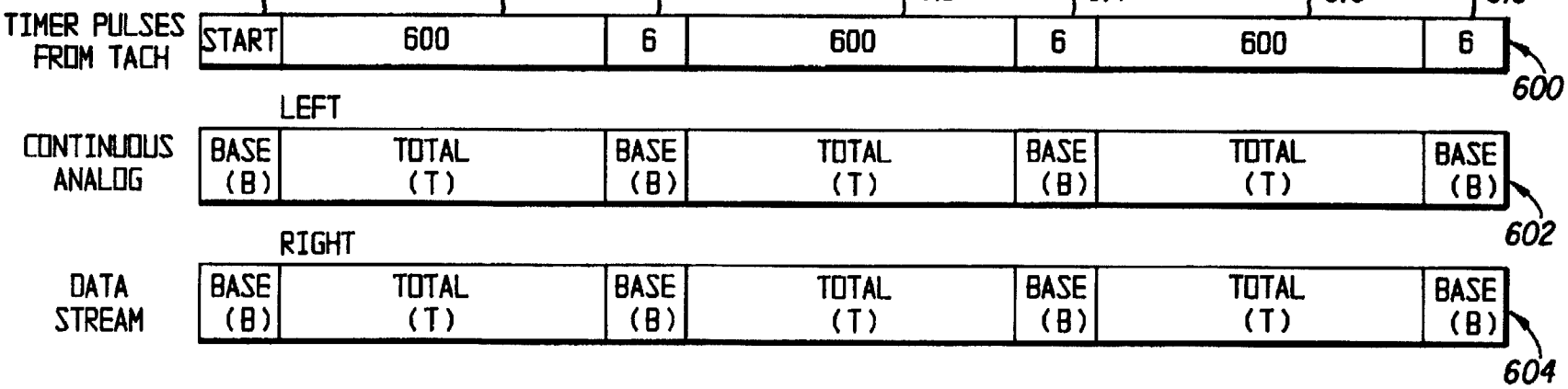
FIG. 6 is a diagram of a timing chart which illustrates the manner and timing of the processing of the signals produced by the digital radiation sensors for use in the real-time control of both the base sheet and top load.

FIG. 6 is a diagram of the timing signals used to implement the base sheet control and top load control functions of the present invention. The top timing line 600 of FIG. 6 illustrates the timer pulses which are produced by the tachometer 302. Preferably, each pulse represents one second.

The timing lines 602 and 604 represent the continuous analog data stream which is output by the digital sensors 204, 206, respectively. They illustrate, as will be described further herein, the manner in which the measurement and control system of the present invention operates to first measure the weight and sheet profile of the cast base sheet 115 and then to measure the total weight of the composite tobacco cast sheet 200. The measurement of the total weight of the composite tobacco cast sheet 200 is interrupted periodically to remeasure the weight and sheet profile of the cast base sheet 115.

In operation, when the production line shown in FIG. 1 is started at period 606, the output signals from the digital sensors 204, 206, as fed to the controller 312 through the data collector 310, are used by the controller 312 to generate the cast base sheet weight signals 502, 503 in order to determine the weight of the cast base sheet 115 and the sheet profile of the wet laid tobacco slurry prior to placing any of the dry granular tobacco top load on that wet laid sheet. Once the weight and therefore the height or thickness of that cast base sheet 115 has been determined to be at or adjusted to the desired weight and profile, using the process control system shown, for example, in FIG. 4, then the top loader 104 is activated. The controller 312 is then switched over (by means of software, or otherwise) to utilize the reference signals generated by the digital sensors 204, 206 to calculate the total sheet weight of the composite tobacco cast sheet product 200. The controller 312 continues to monitor the total weight of the composite tobacco cast sheet 200 for a period of time, for example, 600 seconds. As previously described, that 600 second time period corresponds to the receipt of 600 pulses from the tachometer 302.

After the expiration of the 600 second time period 608 during which the controller 312 functions to monitor the total weight of the composite tobacco cast sheet 200 using the process control system shown in FIG. 5 and to apply the calculated amount of dry granular tobacco to the wet laid tobacco sheet prior to drying, the controller 312 then switches back at period 610 to monitor the weight of the cast base sheet 115 for a period of, for example, 6 seconds. It should be understood that while the time periods given herein are preferred, the importance attached to those time periods is the relationship between the amount of time the controller 312 monitors and controls the total sheet weight of the composite tobacco cast sheet 200 with respect to the time the controller monitors the weight and sheet profile of the cast base sheet 115. Preferably, the relationship is of the order of 100 to 1. That is because it has been found that once the cast sheet line is up and running, the stability of the cast base sheet 115 can be maintained at its preset predetermined thickness. The top loading of the dry granular tobacco, however, is more likely to be uneven and therefore requires more monitoring and adjustment.

After the expiration of the six second time period 610, the controller 312 again switches to monitor the total weight of the composite tobacco cast sheet 200 and adjusts the top loader 104 by means of the speed of the top load variable speed drive 520 in order to control the dropping speed of the top load onto the cast base sheet 115. As shown in the timing diagram of FIG. 6, the controller 312 continues to cycle back and forth between monitoring and controlling the weight and sheet profile of the cast base sheet 115 (at time periods 614 and 618) and monitoring and controlling the total weight of the composite tobacco cast sheet 200 (at time periods 612 and 616), in a similar manner.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A method for controlling the production of a composite tobacco cast sheet having a base sheet having a thickness and a top load of tobacco, comprising the steps of:

measuring the weight of the base sheet and using said measured base sheet weight to generate at least one base sheet weight signal representative thereof;

generating at least one base sheet thickness signal using said at least one base sheet weight signal;

adjusting the thickness of the base sheet dependent upon a comparison of said at least one base sheet thickness signal to a predetermined base sheet thickness signal value representative of a desired thickness;

measuring the weight of said composite tobacco cast sheet and using said measured composite tobacco cast sheet weight to generate at least one composite tobacco cast sheet weight signal representative of the weight of the composite tobacco cast sheet;

initiating a placement of top load tobacco onto said base sheet dependent upon a relationship between said at least one composite tobacco cast sheet weight signal and said at least one base sheet weight signal; and interrupting said placement of top load tobacco onto said base sheet to measure the weight of said base sheet.

2. The method of claim 1, wherein two base sheet thickness signals are generated, one for each of the left and right sides of said base sheet.

3. The method of claim 1, wherein said step of adjusting the thickness of said base sheet further includes the steps of adjusting the thickness of both left and right sides of said base sheet.

4. The method of claim 1, wherein said step of measuring the weight of said base sheet is performed alternatingly with said step of measuring the weight of said composite tobacco cast sheet, with said step of measuring the weight of said base sheet being performed first.

5. The method of claim 1, wherein said step of interrupting said placement of top load tobacco onto said base sheet is intermittent.

6. The method of claim 1, wherein two composite tobacco cast sheet weight signals and two base sheet weight signals are generated, one for each of the left and right sides of said composite tobacco cast and base sheets.

7. The method of claim 6, wherein said step of initiating a placement of top load tobacco onto said base sheet further includes generating an average top load signal based upon said relationships between said two composite tobacco cast sheet weight signals and said two base sheet weight signals.

8. The method of claim 1, wherein said steps of generating at least one base sheet weight and at least one composite tobacco cast sheet weight signals and initiating placement of tobacco top load are alternated with said steps of measuring and adjusting the thickness of said base sheet.

9. The method of claim 8, wherein said steps of measuring and adjusting the thickness of said base sheet have a duration of 1/100 the duration of said steps of generating said at least one composite tobacco cast sheet weight signal and initiating a placement of tobacco top load.

10. The method of claim 1, wherein the same pair of sensors is used to perform both the steps of measuring the weight of said base sheet and generating said at least one base sheet and composite tobacco cast sheet weight signals.

11. The method of claim 10, wherein said sensors are digital sensors which utilize beta particles.

12. In an apparatus for forming a composite tobacco cast sheet product having a cast base sheet having a weight and a thickness and a tobacco top load on said cast base sheet, said apparatus including a head box having a casting blade for casting said cast base sheet onto a moving conveyor, a dryer for drying said cast base sheet while on said conveyor, a top loader located above said conveyor prior to said dryer and a redryer located after said dryer, the system for controlling the forming of said composite tobacco cast sheet product, comprising:

sensors located after said dryer for detecting radiation impinging on said composite tobacco cast sheet product and for producing first and second sensor signals;

means for analyzing said first and second sensor signals to generate head box and top loader control signals; and motors responsive to said head box and top loader control signals for controlling the position of said casting blade in said head box and for controlling the speed of said top loader;

whereby said thickness of said base sheet and the weight of said composite tobacco cast sheet product are controlled to desired values.

13. The apparatus of claim 12, wherein said sensors, said means for analyzing and said motors for controlling the position of said cutting blade are used to control the thickness of said cast base sheet.

14. The apparatus of claim 12, wherein said sensors, said means for analyzing and said motor responsive to said top loader control signal are used to control the weight of said composite cast tobacco sheet product.

15. The apparatus of claim 12, wherein said sensors and said means for analyzing are used alternately to control said motors for controlling said position of said casting blade in said head box and the motor for controlling the speed of said top loader, thus alternately controlling the thickness of said cast base sheet and the weight of said composite tobacco cast sheet product.

16. The apparatus of claim 15, wherein said sensors and said means for analyzing are used to control said weight of said composite tobacco cast sheet product for approximately 100 times the duration such elements are used to control the thickness of said cast base sheet.

17. The apparatus of claim 12, wherein said first and second sensor signals are representative of the weight and thickness of said cast base sheet and the weight of said composite tobacco cast sheet.

18. Apparatus for controlling the forming of a composite tobacco cast sheet product having a cast base sheet having a thickness and a tobacco top load, comprising:

at least one sensor located adjacent to said composite tobacco cast sheet being formed for producing first and second sensor signals;

means for calculating the weight and thickness of said cast base sheet using said first sensor signal and for generating a thickness control signal representative of a predetermined desired thickness of said cast base sheet using said first sensor signal; and means for calculating the weight of said composite tobacco cast sheet product using said first and second sensor signals and for generating a top load control signal representative of a predetermined desired weight of said composite tobacco cast sheet product using said first and second sensor signals;

whereby said thickness of said cast base sheet and the weight of said composite tobacco cast sheet product are controlled to desired values.

19. The apparatus of claim 18, further including a motor driven top loader for placing top load tobacco onto said cast base sheet in response to said top load control signal.

20. The apparatus of claim 18, further including at least one drive means for moving a casting blade mounted in a head box casting said cast base sheet, said at least one drive means being controlled by said thickness control signal.

21. The apparatus of claim 20, wherein said at least one sensor, said means for calculating the weight and thickness of said cast base sheet and said at least one drive means for controlling the position of said casting blade are used to control the thickness of said cast base sheet.

22. The apparatus of claim 18, further including a second sensor located adjacent to said first sensor for producing third and fourth sensor signals.

23. The apparatus of claim 22, wherein said first and third and said second and fourth sensor signals correspond to each of the left and right sides of one of said cast base sheet and said composite tobacco cast sheet product.

24. The apparatus of claim 18, wherein said at least one sensor alternatingly produces said first and second signals for said means for calculating the thickness and weight of said cast base sheet and said means for calculating the weight of said composite tobacco cast sheet product.

25. The apparatus of claim 24, further including a second sensor located adjacent to said first sensor for producing third and fourth sensor signals.

26. The apparatus of claim 25, wherein said first and second sensors and said means for calculating the weight and thickness of said cast sheet and the weight of said composite tobacco cast sheet product are used to control said weight of said composite tobacco cast sheet product for approximately 100 times the duration such elements are used to control the thickness of said cast base sheet.

27. A method for controlling the formation of a composite tobacco cast sheet product having a cast base sheet with a thickness and weight to which a top load of tobacco is added, comprising the steps of:

alternatingly measuring, using the same set of sensors, both the weight of said cast base sheet and the weight of said composite tobacco cast sheet product, said set of sensors generating first and second sensor signals;

analyzing said first and second sensor signals and alternatingly generating signals for controlling the thickness of said cast base sheet using said first sensor signal representative of the weight of said cast base sheet, and the weight of said composite tobacco cast sheet product, using both said first and second sensor signals; and controlling the thickness of said cast base sheet and the weight of said composite tobacco cast sheet product.

28. The method of claim 27, wherein said set of sensors further generates third and fourth sensor signals and said second and fourth sensor signals are proportional to the weight of the left and right sides of said composite tobacco cast sheet product.

29. The method of claim 27, wherein said step of controlling the thickness of said cast base sheet further includes the step of actuating a casting blade mounted in a head box casting said cast base sheet to a position consistent with a desired thickness of said cast base sheet.

30. The method of claim 27, wherein said step of controlling the weight of said composite tobacco cast sheet product further includes the step of actuating a tobacco top loader to place tobacco on said cast base sheet in an amount consistent with a desired weight of said composite tobacco cast sheet product.

31. The method of claim 27, wherein said weight of said composite tobacco cast sheet product is controlled compared to controlling the thickness of said cast base sheet in a ratio of 100:1.

32. The method of claim 27, wherein said set of sensors further generates third and forth sensor signals and said first and third sensor signals are proportional to the thickness and weight of the left and right sides of said cast base sheet.

* * * * *